US011242577B2

(12) United States Patent
Miao et al.

(10) Patent No.: US 11,242,577 B2
(45) Date of Patent: Feb. 8, 2022

(54) RACK STEEL PLATE WITH A THICKNESS UP TO 177.8 MM BY A CONTINUOUS CASTING SLAB AND MANUFACTURING METHOD THEREOF

(71) Applicant: JIANGYIN XING CHENG SPECIAL STEEL WORKS CO., LTD, Jiangsu (CN)

(72) Inventors: Pifeng Miao, Jiangsu (CN); Gang Qian, Jiangsu (CN); Guanyou Liu, Jiangsu (CN); Liang Chen, Jiangsu (CN); Xiaolin Wu, Jiangsu (CN); Jingtao Li, Jiangsu (CN); Zhuzhong Gao, Jiangsu (CN); Xiaojiang Ruan, Jiangsu (CN)

(73) Assignee: JIANGYIN XING CHENG SPECIAL STEEL WORKS CO., LTD, Jiangsu (CN)

( * ) Notice: Subject to any disclaimer, the term of this patent is extended or adjusted under 35 U.S.C. 154(b) by 145 days.

(21) Appl. No.: 16/342,917

(22) PCT Filed: Oct. 18, 2016

(86) PCT No.: PCT/CN2016/102350

§ 371 (c)(1),
(2) Date: Apr. 17, 2019

(87) PCT Pub. No.: WO2018/072076

PCT Pub. Date: Apr. 26, 2018

(65) Prior Publication Data

US 2020/0071783 A1 Mar. 5, 2020

(51) Int. Cl.

| | |
|---|---|
| ***C21D 9/00*** | (2006.01) |
| ***B22D 11/00*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/54*** | (2006.01) |

(52) U.S. Cl.

CPC ..... *C21D 9/0081* (2013.01); *B22D 11/001* (2013.01); *C21D 6/004* (2013.01); *C21D 6/005* (2013.01); *C21D 6/008* (2013.01); *C21D 8/0205* (2013.01); *C21D 8/0226* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/54* (2013.01)

(58) Field of Classification Search

CPC ..... C21D 6/00; C21D 6/001; C21D 6/002; C21D 6/004; C21D 6/005; C21D 6/007; C21D 6/008; C21D 6/02; C21D 6/04; C21D 8/00; C21D 8/005; C21D 8/02; C21D 8/0205; C21D 8/021; C21D 8/0221; C21D 8/0226; C21D 8/0263; C21D 8/04; C21D 8/0405; C21D 8/041; C21D 8/0426; C21D 8/0463; C21D 8/12; C21D 8/1205; C21D 8/1222; C21D 8/1261; C21D 9/0081; C21D 9/42; C21D 9/46; C21D 9/48

See application file for complete search history.

(56) References Cited

U.S. PATENT DOCUMENTS

2014/0314616 A1* 10/2014 Miyata ..... C21D 8/0273 420/83

FOREIGN PATENT DOCUMENTS

| | | | |
|---|---|---|---|
| CN | 103469106 A | * | 12/2013 |
| CN | 103469106 A | | 12/2013 |
| CN | 103556075 A | | 2/2014 |
| CN | 103725986 A | | 4/2014 |

(Continued)

OTHER PUBLICATIONS

International Search Report of PCT/CN2016/102350 dated Jul. 21, 2017, ISA/CN.

*Primary Examiner* — Vanessa T. Luk

(74) *Attorney, Agent, or Firm* — Yue (Robert) Xu; Apex Attorneys at Law, LLP

(57) ABSTRACT

The present invention relates to a rack steel plate with a thickness up to 177.8 mm by a continuous casting slab, the constituents and mass percentages including C0.11~0.15%, Si0.15~0.35%, Mn0.95~1.25%, P≤0.010%, S≤0.002%, Cr0.45~0.75%, Mo0.4~0.6%, Ni1.3~2.6%, Cu0.2~0.4%, Al0.06~0.09%, V0.03~0.06%, Nb≤0.04%, N≤0.006%, B0.001~0.002%, the balance is Fe and unavoidable impurity elements. The manufacture method includes, in sequence, KR molten steel pretreatment, converter smelting, LF refining, RH refining, continuous casting through a straight-arc continuous casting machine, shielding the continuous casting slab a cover and slowly cooling, cleaning the continuous casting slab, heating, high-pressure water descaling, control rolling, straightening, slowly cooling, quenching and tempering treatment. The rack steel plate of large thickness in present invention has advantages of high strength, good plasticity and excellent toughness at a low temperature, the process method has advantages of simple process, low cost and efficiently quick etc.

5 Claims, No Drawings

(56) References Cited

FOREIGN PATENT DOCUMENTS

| | | | | |
|---|---|---|---|---|
| CN | 104357755 | A | * | 2/2015 |
| JP | 2004169093 | A | | 6/2004 |

* cited by examiner

RACK STEEL PLATE WITH A THICKNESS UP TO 177.8 MM BY A CONTINUOUS CASTING SLAB AND MANUFACTURING METHOD THEREOF

The present application is a U.S. National Phase application based upon PCT Application Serial No. PCT/CN2016/102350 filed on Oct. 18, 2016 which titled "TOOTHED RACK STEEL PLATE HAVING THICKNESS OF 177.8 MM AND MANUFACTURED BY CONTINUOUS CASTING BILLET AND MANUFACTURING METHOD THEREFOR", the entire disclosures of which are incorporated herein by reference.

TECHNICAL FIELD

The present application relates to a field of manufacturing a rack steel plate, specially relates to a rack steel plate with a thickness up to 177.8 mm by a continuous casting slab and manufacturing method thereof.

BACKGROUND ART

The rack steel plate for self-elevating marine platform requires high strength, good plasticity, high toughness and large thickness, and requires a uniform performance along the steel plate thickness direction, for example, the steel rack plate with a thickness of 177.8 mm for self-elevating marine platform requires: yield strength is ≥690 MPa, tensile strength is 770~940 MPa, elongation is ≥14%, and at low temperature (normally, at ¼ thickness of the steel plate at −40°, at the center of the steel plate, i.e. at ½ thickness of the steel plate at −30° C.) Charpy impact energy is ≥69 J. Hence, industry always devotes to developing a rack steel plate of large thickness that meets this requirement, and has developed using a moulded casting ingot to manufacture the rack steel plate of large thickness and the manufacturing method thereof. For example, the invention patent of publication number CN102345045A disclosed a rack steel plate with a thickness of 120~150 mm by the moulded casting ingot for marine platform and manufacturing method thereof. With regards to the rack steel plate manufactured by the moulded casting ingot, not only the production technology is complicated but also the yield ratio is low, so that the manufacturing cost dramatically increases.

DISCLOSURE OF INVENTION

The technical problem to be solved in present application is to provide a rack steel plate with a thickness up to 177.8 mm of high strength, good plasticity and excellent toughness at a low temperature, the rack steel plate adopts a manufacturing process of a continuous casting slab, and has advantages of simple process, low cost and efficiently quick etc.

The technical solution of solving above problem is: a rack steel plate with a thickness up to 177.8 mm by a continuous casting slab, the chemical constituents of the steel plate are, by mass percentage, C: 0.11~0.15%, Si: 0.15~0.35%, Mn: 0.95~1.25%, P: ≤0.010%, S: ≤0.002%, Cr: 0.45~0.75%, Mo: 0.4~0.6%, Ni: 1.3~26%, Cu: 0.2~0.4%, Al: 0.06~0.09%, V: 0.03~0.06%, Nb: ≤0.04%, N: ≤0.006%, B: 0.001~0.002%, the balance is Fe and unavoidable impurity elements.

Further, the thickness of the rack steel plate is 11.4.3~177.8 mm, adopting manufacture by a continuous casting slab.

The mechanical performance of the rack steel plate satisfies: yield strength is ≥690 MPa, tensile strength is 770~940 MPa, elongation is ≥16%, area reduction of Z-direction of the steel plate is ≥35%, Charpy impact energy measured at ¼ thickness of the steel plate at −40° C. is >100 J, Charpy impact energy measured at ½ thickness of the steel plate at −30° C. is >100J, and Charpy impact energy measured at ½ thickness of the steel plate at −40° C. is >100 J.

The manufacturing process of the rack steel plate is, raw materials being processed by KR molten steel pretreatment, converter smelting, LF refining, RH refining, and continuous casting through a straight-arc continuous casting machine, in sequence, thereby obtaining high-purity molten steel and high-quality continuous casting slab of a thickness of 370 mm or more. The continuous casting slab meets following requirements: central segregation is equal to or better than class C grade 0.5, center porosity is equal to or better than grade 0.5, free of center cracks, corner cracks or triangular area cracks; regarding inclusions, coarse inclusions of Group A, Group B and Group C=0, coarse inclusions of Group D≤0.05, fine inclusions of Group A≤0.5, fine inclusions of Group B≤0.5, fine inclusions of Group C=0; fine inclusions of Group D≤0.05; Group Ds≤0.5. Compared with the method adopting VD refining and a cast disclosed in invention patent of CN102345045A, the present invention adopts RH refining and continuous casting. The molten steel of much lower H content is obtained by RH refining so as to ensure the ability of resistance against hydrogen cracking of the rack steel plate and the mechanical performance at ½ thickness of the steel plate (center). The slab by continuous casting has a better central quality (for example, central segregation and center porosity and inclusions) than the ingot by moulded casting, helps to ensure the mechanical performance at ½ thickness of the steel plate.

The continuous casting slab is shielded with a cover and is slowly cooled to 200±50° C., then is removed out of the cover, to further decrease H content therein, thereby, further avoid hydrogen cracking of the steel plate and ensure the mechanical performance at ½ thickness of the steel plate. After slowly cooling, the surfaces of the continuous casting slab are cleaned with temperature to ensure the surface quality of the continuous casting slab, and simultaneously ensure that no cracks are generated on the surface of the continuous casting slab during the flame cleaning.

The continuous casting slab is heated to 1180~1280° C., and kept warm for 2~4 hours, and the alloy elements are sufficiently dissolved in steel, bringing the effect of the strength and toughness, to ensure the uniformity of constituents and mechanical performance of the final product. After keeping warm, the continuous casting slab is treated by high-pressure water descaling and then rolled under two stages: the first stage is coarse rolling, the rolling starting temperature is 1050~1150° C., and the total compression ratio is ≥40%, the rolling is performed under strong pressure, the maximum reduction rate of a single pass is ≥17%. Compared with the maximum reduction rate of a steel plate of large thickness about 10% under the conventional coarse rolling in a single pass, the present invention claims the maximum reduction rate of a single pass is ≥17%, to ensure the defects at the center of the continuous casting slab are sufficiently healed, thereby to ensure the mechanical performance at ½ thickness of the rack steel plate of large thickness. The second stage is fine rolling, the rolling starting temperature is 870~930° C., the total compression ratio is ≥20%, rolling until a thickness of finished products is achieved, after that, the steel plate is air-cooled and straightened;

The straightened steel plate is air-cooled to 600~650° C. on a cooling table, and then is shielded with a cover and slowly cooled, the time is ≥72 hours, or the straightened steel plate is kept warm in 600~650° C. for 24~72 hours and is cooled to 200±50° C. along with the furnace in order to sufficiently decrease or remove H content in rolled steel plate and ensure the mechanical performance at ½ thickness of the finished steel plate, and then the product is air-cooled outside the furnace;

The steel plate which has been cooled to room temperature is treated by quenching and tempering treatment to obtain a finished rack steel plate of large thickness. The quenching heating of the quenching and tempering treatment is performed in a continuous furnace, the quenching heating temperature is 900~930° C., the time in the furnace is 1.8~2.0 min/mm, a quenching machine is used during water quenching until the surface temperature of the steel plate is ≤100° C. and then the steel plate is air-cooled to room temperature; tempering is performed in a continuous furnace, the tempering temperature is 600~660° C., the time in the furnace is 2.5~3.5 min/mm, and then the steel plate is air-cooled outside the furnace to room temperature.

The present invention aims at the demands in marine equipment manufacturing industry for a rack steel plate of high strength, high toughness, good plasticity and large thickness, directly adopts a continuous casting slab of high quality (low central segregation and center porosity, free of cracks) and of high purity manufactured by optimized chemical constituents, high-purity molten steel and optimized continuous casting technique (low casting superheat degree, low casting speed, accurate reduction parameters) as a slab, and manufactures the rack steel plate satisfying the requirements by controlling the rolling and the quenching and tempering treatment. The maximum thickness of the rack steel plate is up to 177.8 mm Compared with the prior art, the main advantages of the present invention focus on:

The rack steel plate of large thickness in the present invention directly adopts the continuous slab without any other processing (for example, multiple plate slabs are formed into the composite slab by combined processing) as the rolling slab, and eliminates the process of cogging in rolling when using the moulded casting ingot as a slab, i.e. eliminating the process of cogging heating, cogging rolling and intermediate slab cutting and cleaning, at the same time, eliminates the combined processing process of the plate slab rolled with the composite slab, and simplifies the process. Compared with the rack steel plate manufactured by moulded casting ingot, the yield rate obviously increases by continuous casting slab, and the production hours are shorten. Hence it reduces the cost of manufacturing the rack steel plate of large thickness, overcomes the deficiencies of prior art, and has obvious cost advantages in industrial production.

In addition, the thickness of the continuous casting slab is far less than the thickness of ingot, so the compression ratio of the rack steel plate of large thickness by the continuous casting slab is smaller than that by the ingot. Hence, in case the reduction rate of a single pass can't be ensured, the central defects of the plate slab are not healed so that the central performance of the rack steel plate can't be ensured, it is also one of the important factors that restricts the increase of the thickness of the high performance rack steel plate. The present invention adopts a continuous casting slab of high quality (low central segregation and center porosity, free of cracks) and high purity manufactured by optimized continuous casting technique (low casting superheat degree, low casting speed, accurate reduction parameters) as a slab, and the maximum reduction rate of a single pass is ≥17% in coarse rolling combined by strict control of H content in each stage of manufacturing the rack steel plate of large thickness, so that solves the problem, and thereby ensures the performance at the center of the rack steel plate.

MODE(S) FOR CARRYING OUT THE INVENTION

The present invention is further described in detail with reference to embodiments. It should be understood that embodiment is only the description to the better embodiment of the present invention, and any restrictions cannot be generated to protection scope of the present invention.

Embodiment 1

The thickness of the rack steel plate relating to the present embodiment is 177.8 mm, the constituents and mass percentages including: C: 0.14%, Si: 0.24%, Mn: 1.08%, P: 0.004%, S: 0.0008%, Cr: 0.68%, Mo: 0.49%, Ni: 2.47%, Cu: 0.22%, Al: 0.073%, V: 0.036%, Nb: 0.02%, N: 0.0027%, B: 0.0013%, the balance is Fe and unavoidable impurity elements, Carbon equivalent Ceq (=C+Mn/6+(Cr+Mo+V)/5+(Cu+Ni)/15)=0.74%.

The process of manufacturing the rack steel plate of large thickness is as follows:

The raw materials configured by above constituents of the rack steel plate are processed in sequence by KR molten steel pretreatment, converter smelting, LF refining, RH refining, continuous casting through a straight-arc continuous casting machine (the thickness of the continuous casting slab is 450 mm), shielding the continuous casting slab with a cover and slowly cooling, cleaning the continuous casting slab, heating (keeping warm), high-pressure water descaling, control rolling, straightening, slowly cooling under control, quenching and tempering treatment.

Further, the special process of above heating, control rolling and cooling is as flows: heating the continuous casting slab (central segregation is class C grade 0.5, center porosity is grade 0.5, free of center cracks, corner cracks and triangular area cracks, regarding inclusions, coarse inclusions of Group A, Group B, Group C and Group D=0; fine inclusions of Group A, Group B and Group D=0.5; fine inclusions of Group C=0, Group Ds=0) to 1260° C. and keeping warm for 3.5 hours, after outside the furnace treating the continuous casting slab by high-pressure water descaling, and then processing completely longitudinally rolling under two stages. The rolling starting temperature of the first stage (i.e. coarse rolling) is 1140° C., the thickness of the intermediate slab is 235 mm, the total compression ratio=47.8%, the maximum reduction rate of a single pass=18.1%; the rolling starting temperature of the second stage (i.e. fine rolling) is 880° C., the thickness of the finished plate is 177.8 mm, the total compression ratio=24.3%. After rolling, the continuous casting slab is straightened, and then is slowly cooled under a control condition (heating the steel plate to 620° C. and keeping warm for 72 hours, and cooling to ~200° C. along with the furnace, and then air-cooling outside the furnace to room temperature).

The steel plate after slowly cooling is heated by quenching in a continuous furnace, the quenching heating temperature is 900° C., the time in the furnace is 1.8 min/mm, a quenching machine is used during water quenching, until the surface temperature of the steel plate is ~70° C., and then the steel plate is air-cooled to room temperature. The steel plate after quenching treatment is treated by tempering in a continuous furnace. The tempering temperature is 660° C., the time in the furnace is 2.8 min/mm, and then the steel plate is air-cooled outside the furnace to room temperature.

The finished steel plate produced by above process has excellent combination performance of high strength, good plasticity, high toughness at a low temperature and high Z-direction performance, its mechanical performance is shown in table 1.

Embodiment 2

The thickness of the rack steel plate relating to the present embodiment is 152.4 mm, the constituents and mass percentages including: C: 0.13%, Si: 0.23%. Mn: 1.08%, P: 0.004%, S: 0.001%, Cr: 0.51%, Mo: 0.49%, Ni: 1.39%, Cu: 0.23%, Al: 0.063%, V: 0.038%, Nb: 0.0019%, N: 0.0042%, B: 0.0013%, the balance is Fe and unavoidable impurity elements, Carbon equivalent Ceq=0.63%.

The process of manufacturing the rack steel plate of large thickness is as follows:

The raw materials configured by above constituents of the rack steel plate are processed in sequence by KR molten steel pretreatment, converter smelting, LF refining, RH refining, continuous casting through a straight-arc continuous casting machine (the thickness of the continuous casting slab is 370 mm), shielding the continuous casting slab with a cover and slowly cooling, cleaning the continuous casting slab, heating (keeping warm), high-pressure water descaling, control rolling, straightening, shielding with a cover and stacking and slowly cooling, quenching and tempering treatment.

Further, the special process of above heating, control rolling and cooling is as flows: heating the continuous casting slab (central segregation is class C grade 0.5, center porosity is grade 0.5, free of center cracks, corner cracks and triangular area cracks, regarding inclusions, coarse inclusions of Group A, Group B, Group C and Group D=0; fine inclusions of Group A and Group B=0.5; fine inclusions of Group C and Group D=0, Group Ds=0) to 1250° C. and keeping warm for 2.5 hours, after outside the furnace treating the continuous casting slab by high-pressure water descaling, and then processing longitudinally rolling under two stages. The rolling starting temperature of the first stage (i.e. coarse rolling) is 1090° C., the thickness of the intermediate slab is 220 mm, the total compression ratio=40.5%, the maximum reduction rate of a single pass=17.8%; the rolling starting temperature of the second stage (i.e. fine rolling) is 900° C., the thickness of the finished plate is 152.4 mm, the total compression ratio=30.7%. After rolling the continuous casting slab is straightened, and then the straightened steel plate is cooled to 600~650° C. on a cooling table, and then is removed away from the cooling table, and then is shielded with a cover and slowly cooled in a stack, until the steel plate is cooled to ~200° C., slowly cooling of the steel plate is finished.

The steel plate after slowly cooling is treated by quenching and tempering treatment in a continuous furnace. The steel plate after slowly cooling is treated by quenching in a continuous furnace, the quenching heating temperature is 920° C., the time in the furnace is 1.8 min/mm, a quenching machine is used during water quenching until the surface temperature of the steel plate is ~90° C., and then the steel plate is air-cooled to room temperature. The steel plate after quenching treatment is treated by tempering in a continuous furnace. The tempering temperature is 620° C., the time in the furnace is 3.5 min/mm, and then the steel plate is air-cooled outside the furnace to room temperature.

The finished steel plate produced by above process has excellent combination performance of high strength, good plasticity, high toughness at a low temperature and high Z-direction performance, its mechanical performance is shown in table 1.

Embodiment 3

The thickness of the rack steel plate relating to the present embodiment is 152.4 mm, the constituents and mass percentages including: C: 0.13%, Si; 0.23%, Mn; 1.04%, P: 0.004%, S: 0.0011%, Cr: 0.50%, Mo: 0.47%, Ni: 1.42%, Cu: 0.22%, Al: 0.069%, V: 0.034%, Nb: 0.0015%, N: 0.0036%, B: 0.0012%, the balance is Fe and unavoidable impurity elements, Carbon equivalent Ceq0.61%.

The process of manufacturing the rack steel plate of large thickness is as follows:

The raw materials configured by above constituents of the rack steel plate are processed in sequence by KR molten steel pretreatment, converter smelting, LF refining, RH refining, continuous casting through a straight-arc continuous casting machine (the thickness of the continuous casting slab is 450 mm), shielding the continuous casting slab with a cover and slowly cooling, cleaning the continuous casting slab, heating (keeping warm), high-pressure water descaling, control rolling, straightening, shielding the continuous casting slab with a cover and stacking and slowly cooling, quenching and tempering treatment.

Further, the special process of above heating, control rolling and cooling is as flows: heating the continuous casting slab (central segregation is class C grade 0.5, center porosity is grade 0.5, free of center cracks, corner cracks and triangular area cracks, regarding inclusions, coarse inclusions of Group A, Group B, Group C and Group D=0; fine inclusions of Group A, Group B and Group D=0.5; fine inclusions of Group C=0, Group Ds=0) to 1250° C. and keeping warm for 2.5 hours, after outside the furnace treating the continuous casting slab by high-pressure water descaling, and then processing completely longitudinally rolling under two stages. The rolling starting temperature of the first stage (i.e. coarse rolling) is 1100° C., the thickness of the intermediate slab is 225 mm, the total compression ratio=50%, the maximum reduction rate of a single pass=20%; the rolling starting temperature of the second stage (i.e. fine rolling) is 910° C., the thickness of the finished plate is 152.4 mm, the total compression ratio=32.3%. After rolling the continuous casting slab is straightened, and then the straightened steel plate is cooled to 600~650° C. on a cooling table, and then is removed away from the cooling table, and then is shielded with a cover and slowly cooled in a stack, until the steel plate is cooled to ~200° C., slowly cooling of the steel plate is finished.

The steel plate after slowly cooling is treated by quenching and tempering treatment in a continuous furnace. The steel plate after slowly cooling is treated by quenching in a continuous furnace, the quenching heating temperature is 900° C., the time in the furnace is 1.9 min/mm, a quenching machine is used during water quenching until the surface temperature of the steel plate is ~100° C., and then the steel plate is air-cooled to room temperature. The steel plate after quenching treatment is treated by tempering in a continuous furnace. The tempering temperature is 660° C., the time in the furnace is 2.7 min/mm, and then the steel plate is air-cooled outside the furnace to room temperature.

The finished steel plate produced by above process has excellent combination performance of high strength, good plasticity, high toughness at a low temperature and high Z-direction performance, is mechanical performance is shown in table 1.

Embodiment 4

The thickness of the rack steel plate relating to the present embodiment is 127 mm, the constituents and mass percentages including: C: 0.11%, Si: 0.28%, Mn: 1.04%, P: 0.004%, S: 0.0009%, Cr: 0.52%, Mo: 0.50%, Ni: 1.36%, Cu: 0.22%, Al: 0.072%, V: 0.038%, N: 0.0031%, B: 0.0017%, the balance is Fe and unavoidable impurity elements, Carbon equivalent Ceq=0.60%.

The raw materials configured by above constituents of the rack steel plate are processed in sequence by KR molten steel pretreatment, converter smelting, LF refining, RH refining, continuous casting through a straight-arc continuous casting machine (the thickness of the continuous casting slab is 370 mm), shielding the continuous casting slab with a cover and slowly cooling, cleaning the continuous casting slab, heating (keeping warm), high-pressure water descaling, control rolling, straightening, shielding the continuous casting slab with a cover and stacking and slowly cooling, quenching and tempering treatment.

Further, the special process of above heating, control rolling and cooling is as flows: heating the continuous casting slab (central segregation is class C grade 0.5, center porosity is grade 0.5, free of center cracks, corner cracks and triangular area cracks, regarding inclusions, coarse inclusions of Group A, Group B, Group C and Group D=0; fine inclusions of Group A, Group B and Group D=0.5; fine inclusions of Group C=0, Group Ds=0) to 1220° C. and keeping warm for 2.5 hours, after outside the furnace treating the continuous casting slab by high-pressure water descaling, and then processing completely longitudinally rolling under two stages. The rolling starting temperature of the first stage coarse rolling) is 1070° C., the thickness of the intermediate slab is 180 mm, the total compression ratio=51.4%, the maximum reduction rate of a single pass=19.1%; the rolling starting temperature of the second stage (i.e. fine rolling) is 910° C., the thickness of the finished plate is 127 mm, the total compression ratio=29.4%. After rolling the continuous casting slab is straightened, and then the straightened steel plate is cooled to 600~650° C. on a cooling table, and then is removed away from the cooling table, and then is shielded with a cover and slowly cooled in a stack, until the steel plate is cooled to 150° C., slowly cooling of the steel plate is finished.

The steel plate is treated by quenching and tempering treatment in a continuous furnace. The steel plate after slowly cooling is treated by quenching in a continuous furnace, the quenching heating temperature is 930° C., the time in the furnace is 1.8 min/mm, a quenching machine is used during water quenching until the surface temperature of the steel plate is ~70° C., and then the steel plate is air-cooled to room temperature. The steel plate after quenching treatment is treated by tempering in a continuous furnace. The tempering temperature is 640° C., the time in the furnace is 3.0 min/mm, and then the steel plate is air-cooled outside the furnace to room temperature.

The finished steel plate produced by above process has excellent combination performance of high strength, good plasticity, high toughness at a low temperature and high Z-direction performance, its mechanical performance is shown in table 1.

Embodiment 5

The thickness of the rack steel plate relating to the present embodiment is 114.3 mm, the constituents and mass percentages including: C: 0.12%, Si: 0.27%, Mn: 1.04%, P: 0.006%, S: 0.0006%, Cr: 0.49%, Mo: 0.46%, Ni: 1.39%, Cu: 0.22%, Al: 0.0069%, V: 0.034%, N: 0.0022%, B: 0.0016%, the balance is Fe and unavoidable impurity elements. Carbon equivalent Ceq=0.60%.

The raw materials configured by above constituents of the rack steel plate are processed in sequence by KR molten steel pretreatment, converter smelting. LF refining. RH refining, continuous casting through a straight-arc continuous casting machine (the thickness of the continuous casting slab is 370 mm), shielding the continuous casting slab with a cover and slowly cooling, cleaning the continuous casting slab, heating (keeping warm), high-pressure water descaling, control rolling, straightening, shielding the continuous casting slab with a cover and stacking and slowly cooling, quenching and tempering treatment.

Further, the special process of above heating, control rolling and cooling is as flows: heating the continuous casting slab (central segregation is class C grade 0.5, center porosity is grade 0.5, free of center cracks, corner cracks and triangular area cracks, regarding inclusions, coarse inclusions of Group A, Group B and Group C=0, coarse inclusions of Group D=0.5; fine inclusions of Group A and Group B=0.5; fine inclusions of Group C and Group D=0, Group Ds=0) to 1270° C. and keeping warm for 2 hours, after that treating the continuous casting slab by high-pressure water descaling, and then processing completely longitudinally rolling under two stages. The rolling starting temperature of the first stage (i.e. coarse rolling) is 1070° C., the thickness of the intermediate slab is 195 mm, the total compression ratio=47.3%, the maximum reduction rate of a single pass=19.2%; the rolling starting temperature of the second stage (i.e. fine rolling) is 920° C., the thickness of the finished plate is 114.3 mm, the total compression ratio=41.4%. After rolling the continuous casting slab is straightened, and then the straightened steel plate is cooled to 600~650° C. on a cooling table, and then is removed away from the cooling table, and then is shielded with a cover and slowly cooled in a stack, until the steel plate is cooled to 150° C., slowly cooling of the steel plate is finished.

The steel plate is treated by quenching and tempering treatment in a continuous furnace. The steel plate after slowly cooling is treated by quenching in a continuous furnace, the quenching heating temperature is 900° C., the time in the furnace is 2.0 min/mm, a quenching machine is used during water quenching until the surface temperature of the steel plate is ~50° C., and then the steel plate is air-cooled to room temperature. The steel plate after quenching treatment is treated by tempering in a continuous furnace. The tempering temperature is 650° C., the time in the furnace is 2.5 min/mm, and then the steel plate is air-cooled outside the furnace to room temperature.

The finished steel plate produced by above process has excellent combination performance of high strength, good plasticity, high toughness at a low temperature and high Z-direction performance, its mechanical performance is shown in table 1.

TABLE 1

Mechanical performance of large thickness rack steel plate for marine platform in each embodiment

| Embodiment | Thickness of the steel pate (mm) | Sample position | Yield Strength (MPa) | Tensile Strength (MPa) | Elongation (%) | Charpy Impact Energy Temperature (° C.) | impact energy (J) | | | Z-direction Performance (compression ratio of area, %) | | |
|---|---|---|---|---|---|---|---|---|---|---|---|---|
| 1 | 177.8 | ¼ thickness of plate | 755 | 837 | 22.5 | −40 | 153 | 157 | 171 | 60.8 | 62.9 | 60.3 |
| | | ½ thickness of plate | 740 | 826 | 20.5 | −30 | 166 | 157 | 173 | | | |
| | | | | | | −40 | 165 | 134 | 133 | | | |
| 2 | 152.4 | ¼ thickness of plate | 838 | 890 | 19.2 | −40 | 142 | 132 | 150 | 59.1 | 57.4 | 61.2 |
| | | ½ thickness of plate | 821 | 879 | 17.6 | −30 | 156 | 143 | 117 | | | |
| | | | | | | −40 | 131 | 109 | 128 | | | |
| 3 | 152.4 | ¼ thickness of plate | 727 | 809 | 19.5 | −40 | 207 | 205 | 216 | 62.3 | 64.1 | 63.8 |
| | | ½ thickness of plate | 716 | 807 | 19.0 | −30 | 215 | 212 | 227 | | | |
| | | | | | | −40 | 177 | 192 | 179 | | | |
| 4 | 127 | ¼ thickness of plate | 769 | 837 | 22.0 | −40 | 208 | 212 | 225 | 63.2 | 65.1 | 64.4 |
| | | ½ thickness of plate | 738 | 810 | 21.0 | −30 | 218 | 229 | 213 | | | |
| | | | | | | −40 | 211 | 220 | 193 | | | |
| 5 | 114.3 | ¼ thickness of plate | 795 | 845 | 19.50 | −40 | 226 | 226 | 220 | 66.0 | 66.1 | 65.4 |
| | | ½ thickness of plate | 772 | 836 | 18.00 | −30 | 204 | 199 | 210 | | | |
| | | | | | | −40 | 141 | 127 | 109 | | | |

As shown in table 1, the Z-direction performance compression ratio of area) of the rack steel plate of large thickness in present invention achieves the top requirement of Z direction compression ratio ≥35% of the steel plate for marine engineering, to ensure the ability of resistance to lamellar tearing of the rack steel plate of large thickness. The Z-direction performance also shows a high compactness of the steel plate along the direction of thickness, hence, it also indicates that the rack steel plate of large thickness directly by the continuous casting slab in present invention has a high compactness, thereby ensures satisfying the strict requirements to the performance of the central part of the rack steel plate.

The invention claimed is:

1. A method of manufacturing a rack steel plate with a thickness up to 177.8 mm by a continuous casting slab, characterized in that raw materials are processed by KR molten steel pretreatment, converter smelting, LF refining, RH refining, and continuous casting through a straight-arc continuous casting machine, in sequence, thereby obtaining high-purity molten steel and high-quality continuous casting slab of a thickness of 370 mm or more, wherein the continuous casting slab meets following requirements:

central segregation is equal to or better than class C grade 0.5, center porosity is equal to or better than grade 0.5, free of center cracks, corner cracks or triangular area cracks;

regarding inclusions, thick inclusions of Group A, Group B and Group C=0, thick inclusions of Group D≤0.5; fine inclusions of Group A≤0.5; fine inclusions of Group B≤0.5; fine inclusions of Group C=0; fine inclusions of Group D≤0.5; Group Ds≤0.5;

then the continuous casting slab is shielded with a cover and is cooled to 200±50° C., then is removed out of the cover, and then the surfaces of every piece of the continuous casting slab are cleaned;

the continuous casting slab is heated to 1180~1280° C., and kept warm for 2~4 hours, after keeping warm, the continuous casting stab is treated by water descaling and then rolled under two stages: the first stage is coarse rolling, wherein the rolling starting temperature is 1050~1150° C., and the total compression ratio is ≥40%;

the rolling is performed under such pressure that the maximum reduction rate of a single pass is ≥17%;

the second stage is fine rolling, wherein the rolling starting temperature is 870~930° C., and the total compression ratio is ≥20%, the rolling continues until a thickness of finished products is achieved after that, the steel plate is air-cooled and straightened;

the straightened steel plate is air-cooled to 600~650° C. on a cooling table, and then is shielded with a cover and cooled in a stack, the time is ≤72 hours, or the straightened steel plate is kept warm in 600~650° C. for 24~72 hours and is cooled to 200±50° C. along with the furnace, and then the product is air-cooled outside the furnace; and the steel plate which has been cooled to room temperature is treated by quenching and tempering treatment, and a finished rack steel plate of large thickness is then obtained.

2. The method of manufacturing a rack steel plate with a thickness up to 177.8 mm by a continuous casting slab according to claim 1, wherein the quenching heating of the quenching and tempering treatment is performed in a continuous furnace, the quenching heating temperature is 900~930° C., the time in the furnace is 1.8~2.0 min/mm, wherein a quenching machine is used during water quenching until the surface temperature of the steel plate is ≤100° C. and then the steel plate is air-cooled to room temperature;

tempering is performed in a continuous furnace, the tempering temperature is 600~660° C., the time in the furnace is 2.5~3.5 min/mm, and then the steel plate is air-cooled outside the furnace to room temperature.

3. The method of manufacturing a rack steel plate with a thickness up to 177.8 mm by a continuous casting slab according to claim 1, wherein the chemical constituents of the steel plate are, by mass percentage, C: 0.11~0.15%, Si: 0.15~0.35%, Mn: 0.95~1.25%, P: ≤0.010%, S: ≤0.002%, Cr: 0.45~-0.75%, Mo: 0.4~0.6%, Ni: 1.3~2.6%, Cu: 0.2~0.4%, Al: 0.06~0.09%, V: 0.03~0.06%, Nb: ≤0.04%, N: ≤0.006%, B: 0.001~0.002%, the balance is Fe and unavoidable impurity elements.

4. The method of manufacturing a rack steel plate with a thickness up to 177.8 mm by a continuous casting slab according to claim 1, wherein the thickness of the rack steel plate is 114.3~177.8 mm.

5. The method of manufacturing a rack steel plate with a thickness up to 177.8 mm by a continuous casting slab according to claim 1, wherein yield strength of the steel plate is ≥690 MPa, tensile strength is 770~940 MPa, elongation is ≥16%, reduction of Z-direction of the steel plate is ≥35%, Charpy impact energy measured at ¼ thickness of the steel plate at −40° C. is >100 J, Charpy impact energy measured at ½ thickness of the steel plate at −30° C. is >100 J, and Charpy impact energy measured at ½ thickness of the steel plate at −40° C. is >100 J.

* * * * *